United States Patent [19]

Shintaku et al.

[11] Patent Number: 4,631,793

[45] Date of Patent: Dec. 30, 1986

[54] FIBER REINFORCED METAL ALLOY AND METHOD FOR THE MANUFACTURE THEREOF

[75] Inventors: Yasuyuki Shintaku, Sennan; Hisashi Hiraishi, Kyoto, both of Japan

[73] Assignees: Chugai Ro Co., Ltd.; Kubota, Ltd., both of Osaka, Japan

[21] Appl. No.: 829,558

[22] Filed: Feb. 14, 1986

Related U.S. Application Data

[63] Continuation of Ser. No. 574,621, Jan. 27, 1984, abandoned.

[51] Int. Cl.[4] ..... B22B 27/00

[52] U.S. Cl. ..... 29/132; 164/97; 164/112

[58] Field of Search ..... 428/545, 608, 611, 614, 428/377, 906; 164/91, 93–95, 97–99, 112; 29/132

[56] References Cited

U.S. PATENT DOCUMENTS

| | | | |
|---|---|---|---|
| 3,427,185 | 2/1969 | Cheatham et al. | 428/608 |
| 3,608,170 | 9/1971 | Larson et al. | 428/545 X |
| 3,691,623 | 9/1972 | Staudhammer et al. | 428/608 |
| 3,999,998 | 12/1976 | Carbonnel et al. | 106/104 X |
| 4,053,011 | 10/1977 | Riewald et al. | 428/545 X |
| 4,279,289 | 7/1981 | Ban et al. | 164/97 |
| 4,457,979 | 7/1984 | Donomoto et al. | 428/608 |
| 4,465,741 | 8/1984 | Yamatsuta et al. | 428/611 |
| 4,489,138 | 12/1984 | Yamatsuta et al. | 264/63 X |

FOREIGN PATENT DOCUMENTS

| | | | |
|---|---|---|---|
| 71449 | 2/1983 | European Pat. Off. | 164/97 |
| 58-34150 | 2/1983 | Japan | 164/94 |
| 2081353A | 2/1982 | United Kingdom | 164/97 |
| 2088761 | 6/1982 | United Kingdom | 164/97 |

*Primary Examiner*—Nicholas P. Godici
*Assistant Examiner*—R. K. Seidel
*Attorney, Agent, or Firm*—Burns, Doane, Swecker and Mathis

[57] ABSTRACT

A fiber reinforced metal alloy comprising a metal matrix and a fibrous reinforcement which is constituted by refractory fibers having a high tensile strength. The fiber reinforced metal alloy is manufactured by the use of a centrifugal casting method.

1 Claim, 7 Drawing Figures

FIBER REINFORCED METAL ALLOY AND METHOD FOR THE MANUFACTURE THEREOF

This application is a continuation of application Ser. No. 574,621 filed Jan. 27, 1984, now abandoned.

BACKGROUND OF THE INVENTION

The present invention relates to a fiber reinforced metal alloy having a high heat resistance, which is especially suited for use as a material for structural components of machines and also to the method for the manufacture thereof.

Hitherto, various types of fiber reinforced metal alloys (FRM) comprising a metal matrix and reinforcement fibers have been proposed. These fiber reinforced metal alloys are composite material wherein the metal matrix comprises, for example, aluminum or titanium and the fiber reinforcement comprises, for example, carbon fibers, silica carbide fibers, boron fibers or alumina fibers. Both the heat resistance and the heat insulating property of any one of these fiber reinforced metal alloys are not so high and, accordingly, they are not suited for use as a material for component parts operable in the high temperature environment, such as, for example, conveyor rolls installed inside a heating furnace for the transportation of materials to be heat-treated and those for the transportation of hot rolled strips.

As a method for the manufacture of the fiber reinforced metal alloy, a liquid phase method is known wherein a melt of metal is poured so as to flow into the interstices among the reinforcement fibers. This liquid phase method is being watched because the process of making a composite structure does not take a long time as compared with that according to a diffusion bonding method which is another method for the manufacture of the fiber reinforced metal alloy. Although the liquid phase method can be classified into melt-penetration process, vacuum casting process and melt-casting process, all of these methods are not satisfactory, and therefore have not been practised on an industrial scale, because none of them give a sufficient productivity.

SUMMARY OF THE INVENTION

The present invention is based on the finding that the fibrous material generally used as curtains for the vestibule of a furnace, a protective covering for a thermocouple and a lining material for interior component parts of a furnace can withstand heat of 1400° C. or higher and has a high tensile strength, and has for its essential object to provide a fiber reinforced metal alloy which, because of the employment of the aforesaid refractory and high strength fibers as the fibrous reinforcement used in the metal alloy, can be used as a material for structural components installed inside a furnace.

It is a related object of the present invention to provide an improved method for the manufacture of the fiber reinforced metal alloy, which is effective to give a relatively high productivity and wherein a centrifugal force is utilized to allow a melt of metal to penetrate uniformly into the interstices among reinforcement fibers.

BRIEF DESCRIPTION OF THE DRAWINGS

These and other objects and features of the present invention will become apparent from the following description taken in conjunction with a preferred embodiment thereof with reference to the accompanying drawings, in which.

DETAILED DESCRIPTION OF THE EMBODIMENTS

Figure 1:
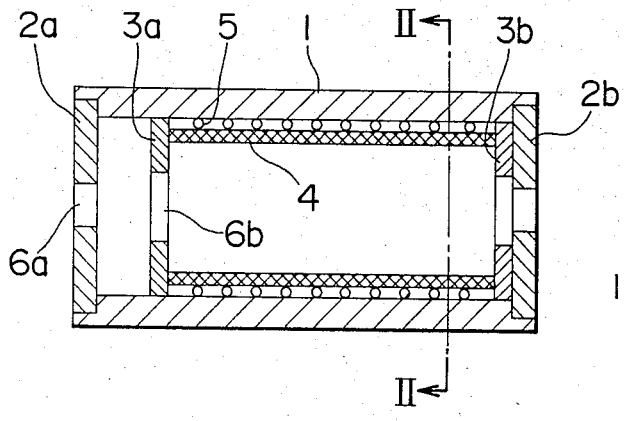
FIG. 1 is a longitudinal sectional view showing schematically a centrifugal casting mold according to a first preferred embodiment of the present invention.
Figure 2:
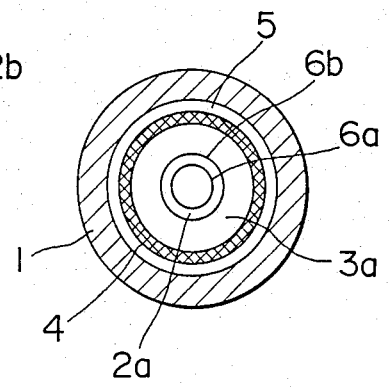
FIG. 2 is a cross sectional view taken along the line II—II shown in FIG. 1.

Before the description of the present invention proceeds, it is to be noted that like parts are designated by like reference numerals throughout the accompanying drawings. It is also to be noted that, in describing a fiber reinforced metal alloy of the present invention, reference will be made for the sake of brevity to a roll manufactured according to a centrifugal casting method and having a layer of fiber reinforced metal alloy embedded in the roll.

Referring first to FIGS. 1 to 4, there is schematically shown a centrifugal casting mold 1 of any known construction. The casting mold 1 is of a generally cylindrical configuration open at both ends thereof and has a centrally perforated end plate 2*a* or 2*b* used to close each open end of the casting mold 1. For manufacturing a cylindrical roll, shown by 8 in FIG. 3, having its exterior surface region embedded with a layer of fiber reinforced metal alloy according to the present invention, an interwoven tube 4 of reinforcement fibers, i.e., a fibrous reinforcement formed by interweaving reinforcement fibers so as to present a generally tubular configuration, is positioned coaxially within the casting mold 1 with its opposite ends held in abutment with support rings 3*a* and 3*b* one for each end of the interwoven tube 4. For avoiding any possible contact of a substantially intermediate portion of the interwoven tube 4 with the inner peripheral surface of the casting mold 1 during the casting operation, a plurality of ring-shaped spacers 5 are mounted exteriorly on the interwoven tube 4 and arranged in equally spaced relation to each other in a direction lengthwise of the casting mold 1. The space between the end plate 2*a* and the support ring 3*a* is made so as to avoid pouring the melt directly on the inner surface of the interwoven tube 4 and so as to avoid the eccentricity and disturbance of the interwoven tube 4. It is to be noted that, instead of the use of the plurality of ring-shaped spacers 5, a single coil of wire may be used as a spacer for the intended purpose.

Preferably, the reinforcement fibers used to form the interwoven tube 4 are comprised of three-element type fibers containing alumina ($Al_2O_3$), boron oxide ($B_2O_3$) and silica ($SiO_2$) in respective quantities of 62 wt %, 14 wt % and 24 wt %.

Figure 3:
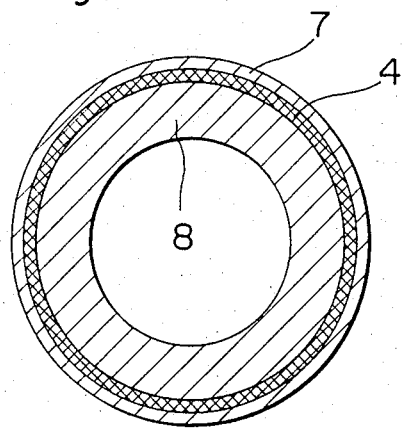
FIG. 3 is a cross sectional view, on an enlarged scale, of a roll manufactured by the use of the casting mold shown in FIG. 1.

The casting of the roll 8 is carried out by pouring a melt of 25Cr-20Ni metal alloy (C: 0.41 wt %, Si: 1.18 wt %, Ni: 20.28 wt %, Mn: 1.02 wt %, P: 0.015 wt %, S: 0.011 wt %, Cr: 24.41 wt %, and Mo: 0.05 wt %) into the casting mold 1 through the central opening 6*a* in the end plate 2*a* and then through the central opening 6*b* in the support ring 3*a* with the interwoven tube 4 supported therein in the manner described above, and then rotating the casting mold 1 in one direction to allow the melt to be radially outwardly forced to adhere to the inner peripheral surface of the casting mold 1 under the influence of a centrifugal force. During the casting so effected, the melt is forced to flow towards the inner peripheral surface of the casting mold 1 through not only the meshes 4*a* (FIG. 4) defined in the interwoven tube 4, but also the interstices among the reinforcement fibers forming the interwoven tube 4 and then into a clearance formed by the spacers 5 between the casting mold 1 and the interwoven tube 4. In practice, the amount of the melt poured into the casting mold 1 is so selected that the interwoven tube 4 can be substantially completely embedded in an annular wall of the resultant roll 8 in a manner as shown in FIG. 3.

Figure 4:
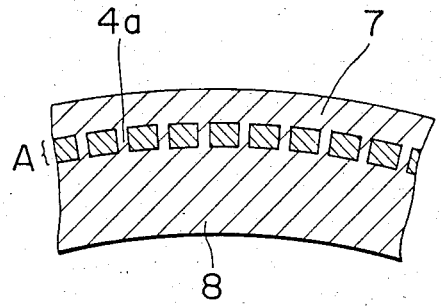
FIG. 4 is a cross sectional view, on a further enlarged scale, showing a portion of the roll shown in FIG. 3.

After the solidification of the melt within the casting mold, the resultant roll 8 is removed out of the casting mold 1. As best shown in FIG. 4, the resultant roll 8 has a layer A of the reinforcement fibers initially defined by the interwoven tube 4 and embedded therein at a location spaced radially inwardly from the outer peripheral surface thereof. To complete the manufacture of the roll 8 having its outer surface region covered substantially by the reinforcement fiber layer A, the roll 8 so cast is subsequently subjected to any known grinding process to remove a surface portion 7 of the roll 8 to make the reinforcement fiber layer A exposed to the outside. However, depending on the particular application in which the roll is used, the removal by grinding of the surface portion 7 may not be always necessary.

It is to be noted that the number of the fibrous reinforcements, shown as the interwoven tube in the illustrated embodiment, may not be always limited to one such as shown, but may be two or more. Where the fibrous reinforcements are laminated, i.e., where two or more interwoven tubes are employed one inside the other in laminated relation, it may happen that the melt of metal alloy will not reach the inner peripheral surface of the casting mold 1 during the centrifugal casting operation. In such case, instead of the use of the spacers 5, a spacer layer of metal having a low melting point such as, for example, Al or Zn within ±15% of the lattice constant of Fe may be centrifugally formed in adherence to the inner peripheral surface of the casting mold 1 prior to the melt of the previously described metal alloy being poured into the mold 1. Where this technique is employed, the aforesaid spacer layer is, when the melt is poured into the casting mold 1 after the spacer layer has been solidified, melted by the heat evolved by the melt and is subsequently dispersed to mix with the melt to ultimately present a diffused solid solution.

It is also to be noted that where the number of the interwoven tubes is two or more, or where the single interwoven tube has so great a wall thickness that the poured melt of the metal alloy will be hard to flow radially outwardly through the interwoven during the centrifugal casting operation even though the above described alternative technique is employed, the interwoven tube may be formed with at least one through-hole at a portion adjacent the central opening 6*a* so that the melt poured into the casting mold 1 through the central opening 6*a* can also flow through the through-hole into the clearance between the casting mold and the interwoven tube 4 during the casting operation.

It is further to be noted that, where the reinforcement fibers used are of a nature easy to melt in contact with the melt of metal alloy, the interwoven tube may have a heat resistant coating applied thereto to avoid any possible melt of the reinforcement fibers.

While according to the foregoing embodiment the layer of the reinforcement fibers embedded in the roll is exposed to the outside by grinding the outer surface portion of the roll, which grinding has been necessitated because of the marks left on the outer surface of the roll by the spacer rings 5, the concept of the present invention can equally be applicable to the manufacture of the roll having the reinforcement fiber layer embedded therein at a location substantially intermediate the wall thickness thereof. This will now be described with particular reference to FIGS. 5 and 6.

Figure 5:
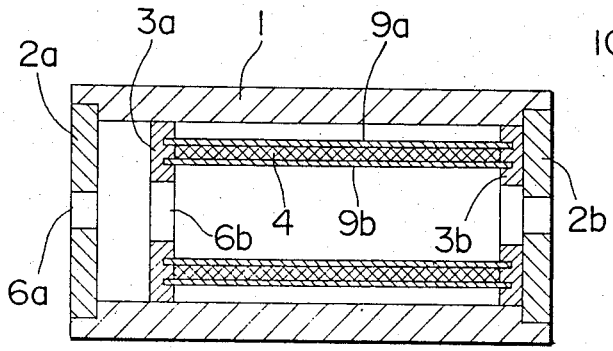
FIG. 5 is a view similar to FIG. 2, showing the centrifugal casting mold according to another preferred embodiment of the present invention.
Figure 6:
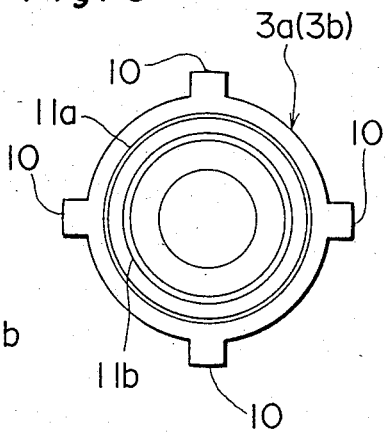
FIG. 6 is an end view, on an enlarged scale, of one of the support rings used in the casting mold shown in FIG. 5.

As best shown in FIG. 5, instead of the spacer rings 5 employed in the foregoing embodiment, outer and inner perforated SUS pipes 9*a* and 9*b*, one inside the other, are employed for the support of the interwoven tube 4. In addition, each of the support rings 3*a* and 3*b* employed in the embodiment shown in FIGS. 5 and 6 is of an outer diameter substantially equal to the inner diameter of the casting mold 1 and has a plurality of spacer projections 10 protruding radially outwardly therefrom and circumferentially equally spaced from each other. Each of the support rings 3*a* and 3*b* is formed with outer and inner circular grooves 11*a* and 11*b* on one surface thereof in coaxial relation to the axial of rotation of the casting mold 1. The interwoven tube 4 is, after having been inserted into an annular clearance defined between the outer and inner perforated SUS pipes 9*a* and 9*b*, supported within the casting mold 1 by the SUS pipes 9*a* and 9*b* having their opposite ends received in the respective outer and inner circular grooves 11*a* and 11*b* in the associated support rings 3*a* and 3*b* as best shown in FIG. 5. It will readily be seen that, because of the particular configuration of each of the support rings 3*a* and 3*b* as shown in FIG. 6, the melt of the metal alloy poured into the casting mold 1 through the central opening 6*a* can flow not only into the inside of the inner SUS pipe 9*b* through the central opening 6*b*, but also into the clearance between the outer SUS pipe 9*a* and the inner peripheral surface of the casting mold 1 through arcuate passages each extending between the adjacent two radially outward projections 10.

During the actual casting operation with the casting mold 1 rotated in one direction about the longitudinal axis thereof, the melt of the 25Cr-20Ni metal alloy poured into the casting mold 1 through the central opening 6*a* into the space between the end plate 2*a* and the support ring 3*a* and flows first into the clearance between the outer SUS pipe 9*a* the casting mold 1 through the arcuate passages and then into the inside of the inner SUS pipe 9*b* through the central opening 6*b* in the support ring 3*a*. The melt entering the inside of the inner SUS pipe 9*b* is, during the continued rotation of the casting mold 1, forced under the influence of the centrifugal force to flow into the clearance between the outer and inner pipes 9*a* and 9*b* through the perforations in the inner pie 9*b* and, substantially at the same time, the outer and inner pipes 9*a* and 9*b* are fused in contact with the elevated temperature of the poured melt.

Figure 7:
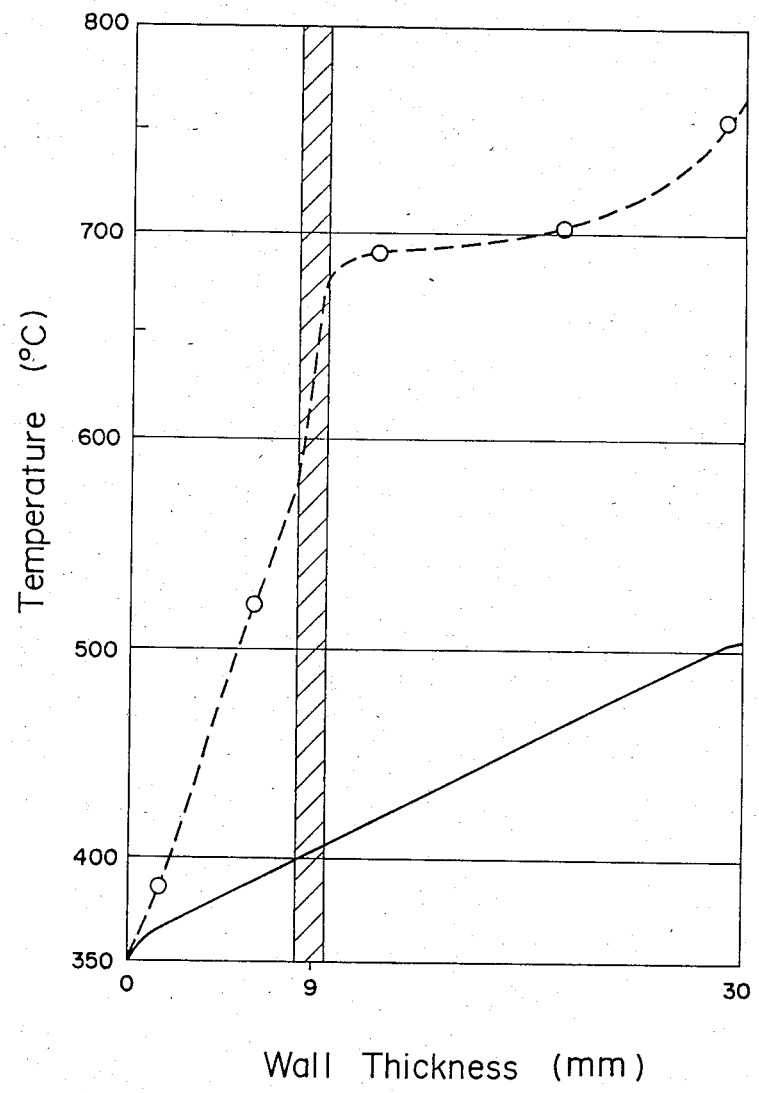
FIG. 7 is a graph showing the temperature distribution in the roll manufactured according to the present invention and the conventional roll.

The roll manufactured according to the second preferred embodiment has the reinforcement fiber layer A embedded intermediate of the wall thickness thereof substantially as shown in FIG. 4. It has been found that when the roll cast at 1,600° C. by the application of a centrifugal force of 58 G in accordance with the second preferred embodiment of the present invention and having a wall thickness of 30 mm was tested, it exhibited a temperature distribution as shown by the broken line in FIG. 7. For the purpose of comparison, the temperature distribution exhibited by the conventional roll, 30 mm. in wall thickness, of the same material as the roll according to the present invention, but having no reinforcement fiber layer is also shown by the solid line in the graph of FIG. 7. In the graph of FIG. 7, the values "0" and "30" of the wall thickness represent the inner and outer peripheral surfaces of the roll. These temperature distributions were obtained by exposing the inner and outer peripheral surfaces of the roll according to the invention and the conventional roll to the atmospheres of 350° C. and 1,300° C., respectively.

Although the present invention has fully been described in connection with the preferred embodiment thereof, it is to be noted that various changes and modifications are apparent to those skilled in the art. Accordingly, such changes and modifications are to be understood as included within the scope of the present invention as defined by the appended claims, unless they depart therefrom.

What is claimed is:

1. A hollow cylindrical metallic body which comprises a metal matrix and a composite material comprised of a generally pipe-like braided element of inorganic reinforcing fibers individually comprised of alumina, boron oxide and silica mixed in a predetermined mixing ratio, said metal matrix being positioned on each of the inner and outer peripheral surfaces of the braided element and infiltrated therethrough and being cast together with the braided element by the use of a centrifugal casting technique.

* * * * *